United States Patent [19]

Chauvin

[11] Patent Number: 4,917,566

[45] Date of Patent: Apr. 17, 1990

[54] CRANE ATTACHMENT FOR BACKHOE

[75] Inventor: J. Raymond Chauvin, Hyde Park, Vt.

[73] Assignee: Contractors Crane Service, Inc., Morrisville, Vt.

[21] Appl. No.: 272,628

[22] Filed: Nov. 17, 1988

[51] Int. Cl.[4] ..... E02F 3/00

[52] U.S. Cl. ..... 414/722; 37/117.5; 212/255; 414/912; 414/680; 254/386

[58] Field of Search ..... 414/563, 560, 912, 694, 414/680, 722, 723, 727, 732, 729, 687; 37/117.5, 115, 116, 125, 135; 254/386, 385; 212/175, 177, 255

[56] References Cited

U.S. PATENT DOCUMENTS

| | | | |
|---|---|---|---|
| 2,808,166 | 10/1957 | Stine | 254/386 X |
| 3,113,681 | 12/1963 | Crile | 212/228 X |
| 3,396,946 | 8/1968 | Maddock | 254/386 X |
| 3,836,025 | 9/1974 | Olson et al. | 414/912 X |
| 3,874,532 | 4/1975 | Metailler | 414/912 X |
| 4,168,053 | 9/1979 | Boenninghaus | 254/386 X |
| 4,523,684 | 6/1985 | Baisden | 414/912 X |
| 4,741,661 | 5/1988 | Carey | 414/563 |

FOREIGN PATENT DOCUMENTS

| | | | |
|---|---|---|---|
| 2829441 | 1/1980 | Fed. Rep. of Germany | 414/912 |

*Primary Examiner*—Frank E. Werner
*Assistant Examiner*—James T. Eller
*Attorney, Agent, or Firm*—Limbach, Limbach & Sutton

[57] ABSTRACT

The invention enables owners of backhoes and similar equipment to use their machines either as a backhoe or as a crane with only minor modifications. The invention provides an attachment for a backhoe that takes advantage of existing hydraulic pistons on the backhoe as the lift implement for the crane.

2 Claims, 1 Drawing Sheet

CRANE ATTACHMENT FOR BACKHOE

BACKGROUND OF THE INVENTION

1. Field of the Invention

The present invention relates to an crane attachment for a backhoe; and more particularly, a crane attachment in which the existing hydraulic piston for the backhoe dipperstick is used as the lift means.

2. Description of the Prior Art

Backhoes and crane as separate and distinct material handling machines are well known in the prior art. Small building contractors normally, however, are not able to afford a traveling crane or similar vertically swinging hoist. Nonetheless, a small contractor must move heavy material from one location to another on a number of occasions during a construction job. Still, while a small contractor does have occasions on which the use of a traveling crane would be useful, these occasions are not substantial enough to justify heavy capital investment in equipment designed solely for that use.

Small contractors generally do have a backhoe available for their use. Backhoes typically comprise tractors having arms known as booms adapted to be moved vertically by hydraulic means. At the end of the boom there is an additional arm or dipperstick. At the end of the dipperstick a working member, typically a bucket, is so attached to be rotatably, or pivotally, movable, again by hydraulic means. In the conventional design and operation of a backhoe, the rotational motion of the working member is employed to perform a digging or scooping function.

In the prior art, it has been known to utilize material handling machines such as backhoes to perform functions other than the design intended digging or scooping functions, both with and without modification to the equipment. Examples of such prior art attempts can be found in U.S. Pat. No. 2,446,220 to Erdahl, U.S. Pat. No. 2,660,816 to Maxwell, U.S. Pat. No. 3,233,687 to Grimes, U.S. Pat. No. 3,812,979 to Leihgeber, U.S. Pat. No. 4,035,936 to Avara, U.S. Pat. No. 4,200,423 to Sornsin, and U.S. Patent No. 4,425,072 to Lewis.

The patent to Erdahl discloses a combined crane and material moving device. When the scoop is to be used, the hook for the crane is locked by attachment to the crane boom. The crane boom has a number of sheaves that accommodate the crane cables.

The patent to Maxwell discloses a combination bulldozer and shovel arrangement. The shovel is mounted on the top of a tractor via vertical frames. The cables or chains for the shovel revolve about an idler sprocket which is on the upper end of the vertical frames.

The patent to Grimes discloses a drop hammer combined with a backhoe or power shovel. The drop hammer hangs from a cable that rotates around a drum. The drum is supported on a shaft which is mounted on forward ends of a pair of arms. The arms are in turn mounted to the sides of the backhoe shovel or bucket.

The patent to Leihgeber discloses a lift boom for a front loader tractor. The lift boom is mounted directly to the front loader bucket. The upper cable is mounted to the boom via a pin.

The patent to Avara discloses an attachment for a boom structure with an interchangeable bucket. The invention allows for the use of the boom in both a backhoe and a shovel mode.

The Sornsin patent discloses a boom attachment for a tractor. The invention is similar to that described by Leihgeber, above. The boom is attached directly to the tractor bucket via support plates.

The Lewis patent discloses an extension apparatus for a material handling machine such as a backhoe. The extension device is attached directly to the backhoe bucket via a cable and a fixed mounting plate.

One object of the present invention is to enable a backhoe owner to use the equipment as a backhoe or as a crane with only minor modifications.

Another object of the present invention is to provide an add-on crane attachment for a backhoe whereby the attachment takes advantage of existing hydraulic pistons on the backhoe as the lift means.

Objects and advantages other than those above set forth will be apparent from the following description when read in connection with the accompanying drawings.

SUMMARY OF THE INVENTION

The present invention relates to a crane attachment for a backhoe that has had its dipperstick detached from its boom. The invention is comprised of a hydraulic lift means mounted on the backhoe boom, a bearing means mounted to the hydraulic lift means, and a load suspending means adapted for engaging the bearing means.

The hydraulic lift means is provided by the existing, boom-mounted hydraulic piston normally used for the dipperstick. The bearing means is provided by one or more sheaves mounted on the hydraulic piston. The load suspending means is provided by wire cable running over and engaging one or more of the sheaves.

DESCRIPTION OF THE INVENTION

The invention is specifically designed to enable backhoe and similar equipment to be used either as a backhoe or as a crane with only minor modifications. The invention, however, could also be built separately and without regard to supporting equipment.

In the preferred embodiment, the invention provides a crane attachment for a backhoe whereby the attachment takes advantage of existing hydraulic pistons on the backhoe as the lift means.

Figure 1:
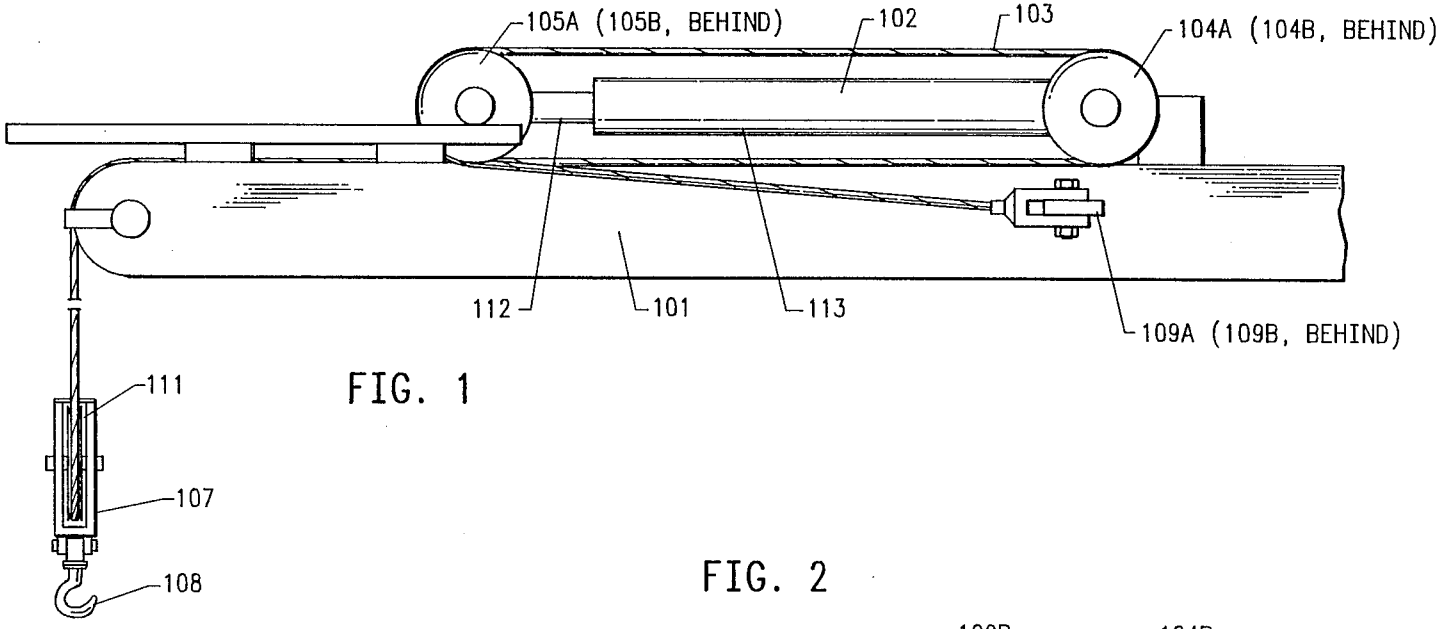
FIG. 1 shows a side view of the attachment of the present invention.
Figure 2:
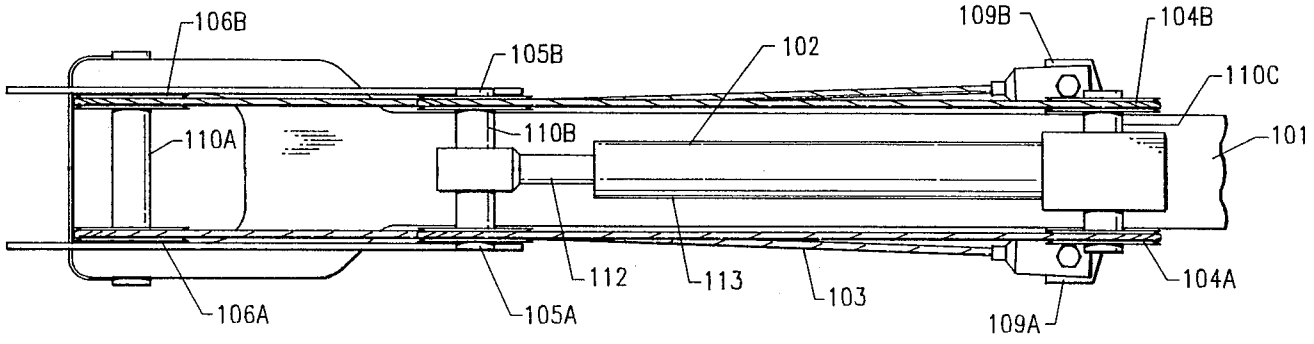
FIG. 2 shows a elevated perspective view of the apparatus of the present invention.

FIGS. 1 and 2 show views of the attachment of the present invention. Both the bucket (not shown) and dipperstick (not shown) have been removed from a commercially available backhoe, such as a 235 Caterpillar Backhoe (not shown). The backhoe boom (101) is modified taking advantage of the existing hydraulic piston (102) that ordinarily would control the movement of the dipperstick (not shown). The hydraulic piston (102) has a rod end (!12) and a cylinder end (113). Front sheaves (105A, 105B) are attached to the hydraulic piston (102) on each side of the rod end (112) and back sheaves (104A, 104B) are attached to the hydraulic piston (102) on each side of the cylinder end (113). Front and back sheaves (104A, 104B, 105A, 105B) provide a bearing means for the wire cable (103). Boom sheaves (106A, 106B) are used at the end of the boom (101), through which the wire cable (103) passes to engage and suspend a terminal sheave (111) which is housed within a sheave block (107) above a crane hook (108), The size of the sheaves is dependent upon wire cable width as is the size of the sheave shafts (110A, 110B, 110C). The wire cable is secured by two beck offs (109A, 109B).

In operation, the lift means for the crane is provided by the piston/cable attachment. The hydraulic piston (102), being the cylinder to control the movement of the dipperstick (not shown) when the equipment is used as a backhoe, operates to control the movement of the crane hook (108). Oil flow to the rod end (112) of the piston causes the rod to retract and the crane hook (108) to be let out.

The invention, by utilizing the existing hydraulic piston (102) as a hydraulic lift means, enables a backhoe owner to use the equipment as a backhoe or as a crane with only minor modifications. Even more importantly, by utilizing the existing hydraulic piston (102) normally used for the dipperstick (not shown) on the backhoe boom (101), the lifting means is far superior in strength and stability to prior art designs, such as disclosed in U.S. Pat. No. 4,200,423 to Sornsin, and U.S. Pat. No. 4,425,072 to Lewis, where crane are attached via extension booms, fixed mounted to the backhoe bucket. Finally, unlike other prior art designs, no additional lifting means is needed or required.

What is claimed is:

1. Am improved backhoe of the type having a boom, adapted such that a dipperstick may be attached to the end of the boom to be moved vertically by an hydraulic piston, having a rod end and a cylinder end, mounted on said boom, and adapted such that a working member, typically a bucket, may be attached to the dipperstick so as to be rotatably, or pivotally, movable, wherein the improvement comprises:

(a) one or more front sheaves mounted on said rod end of said hydraulic piston;

(b) one or more back sheaves mounted on said cylinder end of said hydraulic piston;

(c) one or more boom sheaves mounted on said boom; and (d) a load suspending means engaging and running over said one or more front sheaves, said one or more back sheaves, and said one or more boom sheaves, and having a suspended load engaging means after engaging and running over said one or more boom sheaves.

2. An improved backhoe as in claim 1 wherein said load suspending means comprises wire cable.

* * * * *